US009193035B2

(12) United States Patent
Suzuki et al.

(10) Patent No.: US 9,193,035 B2
(45) Date of Patent: Nov. 24, 2015

(54) SHOT-BLASTING MACHINE

(75) Inventors: Tsunetoshi Suzuki, Toyokawa (JP); Mitsuo Ishikawa, Toyokawa (JP); Ryo Tatematsu, Toyokawa (JP)

(73) Assignee: SINTOKOGIO, LTD., Nagoya-Shi (JP)

( * ) Notice: Subject to any disclaimer, the term of this patent is extended or adjusted under 35 U.S.C. 154(b) by 476 days.

(21) Appl. No.: 13/521,566

(22) PCT Filed: Sep. 1, 2010

(86) PCT No.: PCT/JP2010/064909
§ 371 (c)(1),
(2), (4) Date: Jul. 11, 2012

(87) PCT Pub. No.: WO2011/114550
PCT Pub. Date: Sep. 22, 2011

(65) Prior Publication Data

US 2013/0017767 A1 Jan. 17, 2013

(30) Foreign Application Priority Data

Mar. 17, 2010 (JP) ..... 2010-061556

(51) Int. Cl.
*B24C 3/30* (2006.01)
*B24C 9/00* (2006.01)
*B24C 3/08* (2006.01)

(52) U.S. Cl.
CPC . *B24C 9/00* (2013.01); *B24C 3/085* (2013.01); *B24C 3/30* (2013.01)

(58) Field of Classification Search
CPC ..... B24C 3/085; B24C 3/30; B24C 9/00
USPC ..... 451/85, 86
See application file for complete search history.

(56) References Cited

U.S. PATENT DOCUMENTS 2,440,819 A * 5/1948 Evans ..... 451/3
3,194,571 A * 7/1965 Peickii et al. ..... 277/565

(Continued)

FOREIGN PATENT DOCUMENTS

CN 2661373 Y 12/2004
CN 1935458 A 3/2007

(Continued)

OTHER PUBLICATIONS

Supplementary European Search Report in European Application No. 10847958.5 dated Sep. 29, 2014.

(Continued)

*Primary Examiner* — Lee D Wilson
*Assistant Examiner* — Henry Hong
(74) *Attorney, Agent, or Firm* — Farabow, Garrett & Finnegan, Henderson, Dunner, L.L.P.

(57) ABSTRACT

To provide a novel shot-blasting machine to eliminate a dead space for a cover that shuts an opening for feeding and taking out works and to open and close the cover by moving a rotary drum around an axis. The machine has a cabinet 11, a rotary drum 13 having holes, and a centrifugal shooting machine 15. The rotary drum 13 moves, within the cabinet 11, around an axis through the positions for feeding, processing, and taking out the works. The cabinet 11 comprises a cover 51 for shutting an opening 11*b* for feeding and taking out the works. It has a wall 59 for sealing the side of the opening 11*b*. The cover 51 is integrated with the rotary drum 13 to move around the axis. It has walls 51*a*, 51*b*, 51*d* that fit the wall 59 for sealing. Lip seals 61, 63 seal the gap between the walls 51*a*, 51*b*, 51*d* of the cover 51 and the wall 59 for sealing.

5 Claims, 15 Drawing Sheets

(56) References Cited

U.S. PATENT DOCUMENTS

| | | | | | |
|---|---|---|---|---|---|
| 3,398,926 | A | * | 8/1968 | Scaramucci | 251/172 |
| 3,445,121 | A | * | 5/1969 | Lineker | 277/356 |
| 4,598,501 | A | * | 7/1986 | Vasek | 451/88 |
| 4,646,484 | A | * | 3/1987 | Brull | 451/38 |
| 5,245,798 | A | * | 9/1993 | Carpenter | 451/86 |
| 5,676,588 | A | * | 10/1997 | Frederick et al. | 451/86 |
| 2013/0090044 | A1 | * | 4/2013 | Tatematsu et al. | 451/86 |

FOREIGN PATENT DOCUMENTS

| | | | | | |
|---|---|---|---|---|---|
| EP | 1 974 861 | A1 | | 10/2008 | |
| GB | 2 228 218 | A | | 8/1990 | |
| JP | 61-244463 | | | 10/1986 | |
| JP | 4-87773 | | | 3/1992 | |
| JP | 8-126959 | | | 5/1996 | |
| JP | 08126959 | A | * | 5/1996 | B24C 3/30 |

OTHER PUBLICATIONS

English-language International Search Report from Japanese Patent Office for International Application No. PCT/JP2010/064909, Mailed Dec. 7, 2010.

* cited by examiner (Prior Art)

SHOT-BLASTING MACHINE

TECHNICAL FIELD

The present invention relates to a shot-blasting machine that processes small or thin products by blasting shots so as to descale or deflash them. Specifically, it relates to a shot-blasting machine that processes works, such as metal products, by blasting accelerated shots (blasted materials) on them while they are agitated in a rotary drum that has holes, which drum is rotated in a sealed cabinet.

BACKGROUND ART

The shot-blasting machine basically comprises a cabinet, a rotary drum having holes, and a centrifugal shooting machine. The rotary drum is located inside the cabinet and moves forward and backward around the horizontal shaft through the positions for feeding products to be processed, for processing them, and for taking out them. The shaft passes through the central axis of the rotary drum. The cabinet comprises a cover for shutting the opening that is used to feed the materials to be processed and to take them out.

In conventional shot-blasting machines the cover of the cabinet uses double sliding doors or double swinging doors. For these double sliding doors or double swinging doors additional spaces (dead spaces) for moving the doors have been required. Further, a driving force for the doors, in addition to a driving force for the rotary drum, has been required (see paragraph 0002 of Japanese Patent Laid-open Publication No. H08-126959). Thus in Japanese Patent Laid-open Publication No. H08-126959 the applicant proposed the following shot-blasting machine, wherein the dead spaces that were used for the cover for shutting the opening for feeding and taking out works were eliminated, and wherein the cover was opened and closed by the same driver as that for the rotary drum.

Below, claim 1 of that patent application is referred to, and FIG. 1 is appended to the present application also as FIG. 1. Incidentally, the numbers in FIG. 1 are unrelated to those in FIGS. 2 to 15.

"A shot-blasting machine using a rotary drum, wherein a cabinet 2 is formed in the front side to project like a semicircle 3 in a view from a side, wherein a centrifugal shooting machine 1 is provided on the back and upper side of the cabinet 2, the centrifugal shooting machine being directed forward and downward, wherein a vertical and long arc-shaped opening 4 is formed on the semicircle 3, wherein a semicircular sliding cover 7 is provided to be engaged with the arc-shaped opening 4 through a labyrinth seal, the semicircular sliding cover 7 moving forward and backward around an axis, and wherein, when the sliding cover 7 shuts the arc-shaped opening 4, a rotary drum 13 that has a U-shaped section is provided on the inner face of the sliding cover 7, a leading end of the rotary drum being inclined toward the centrifugal shooting machine 1."

However, since the proposed shot-blasting machine used a labyrinth seal, the structure was complicated, a high degree of accuracy was required, and the cost tended to be high.

DISCLOSURE OF INVENTION

To overcome the above problems, the object of the present inventions is to provide a shot-blasting machine having a novel structure that can have functions and effects that are similar to those of the machine that is described in that publication, but that uses no labyrinth seal.

To solve those problems, the inventors conceived of the shot-blasting machine that has the following structure, as a result of considerable efforts in developing the machine.

The machine comprises a cabinet, a rotary drum that has holes, and a centrifugal shooting machine. The rotary drum is configured to move, within the cabinet, forward and backward around a horizontal shaft that passes through the central axis of the rotary drum. The drum moves through the operating positions for feeding materials to be processed, for processing them, and for taking them out. The cabinet has a cover for shutting the opening for feeding the materials to be processed and taking them out. It has on the side of the opening a wall for sealing that consists of a ceiling, a base, and two side walls. The cover is integrated with the rotary drum and moves forward and backward around an axis together with the rotary drum. It comprises upper and lower arc portions that can fit the wall for sealing, a string portion for connecting the front side of the upper arc portion to the front side of the lower arc portion, and two side portions that enclose the space between the string portion and the upper and lower arc portions. A seal is formed by at least one line of a lip seal that is provided at the gaps between the upper and lower arc portions and the two side portions of the cover and the wall for sealing.

The basic Japanese Patent Application, No. 2010-061556, filed Mar. 17, 2010, is hereby incorporated by reference in its entirety in the present application.

The present invention will become more fully understood from the detailed description given below. However, the detailed description and the specific embodiment are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

BEST MODE FOR CARRYING OUT THE INVENTION

Below an embodiment of the present invention is described with reference to the drawings. Here, unless stated otherwise the top and bottom and forward and backward directions of the cover are determined based on the position when the cover is closed (during the operation for processing).

Figure 1:
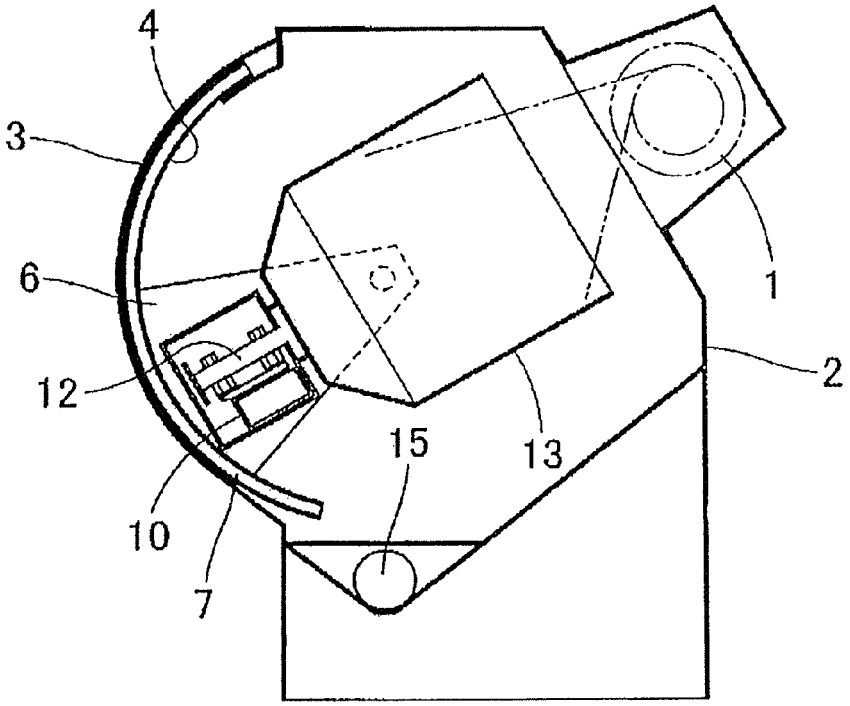
FIG. 1 illustrates a prior-art shot-blasting machine.
Figure 2:
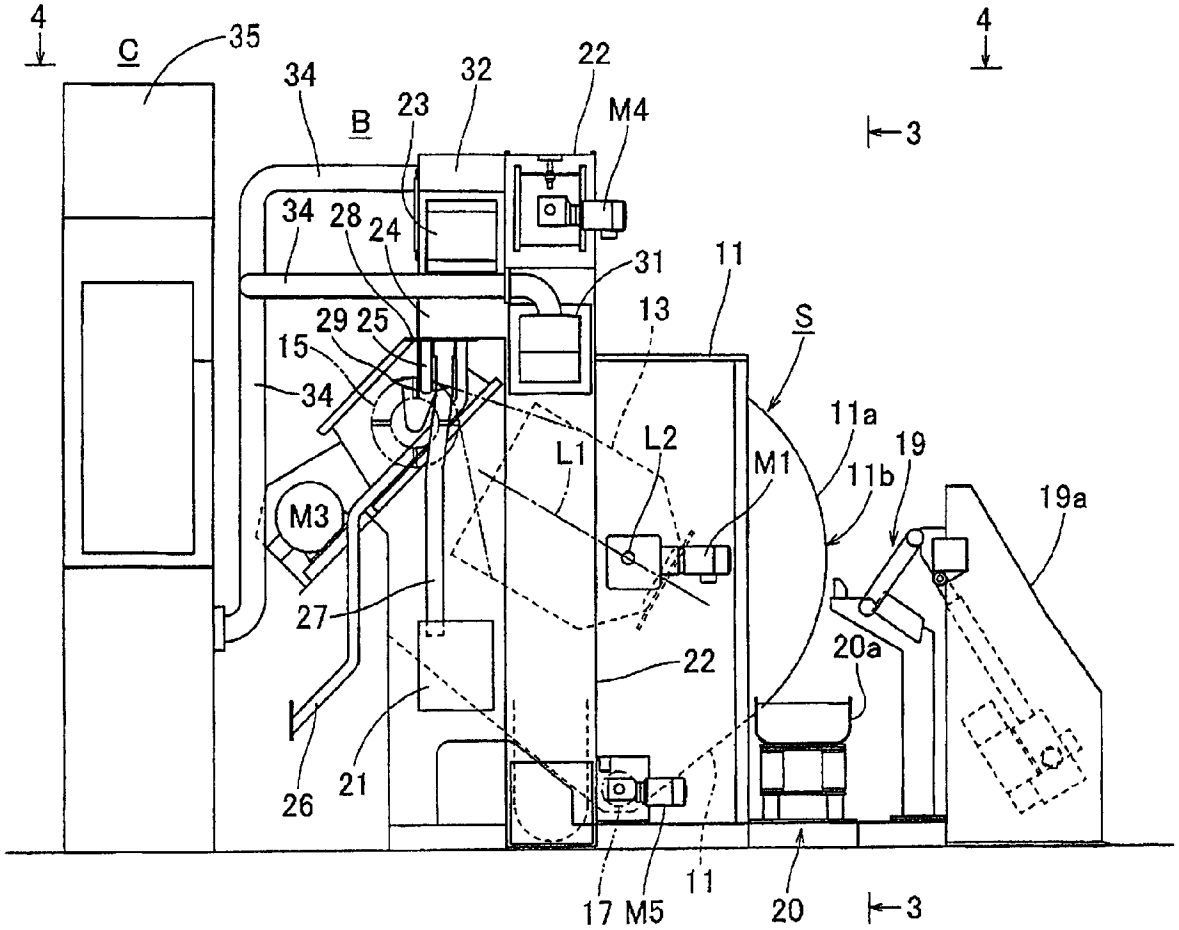
FIG. 2 shows a side view of a shot-blasting facility that incorporates the shot-blasting machine of the present invention.
Figure 3:
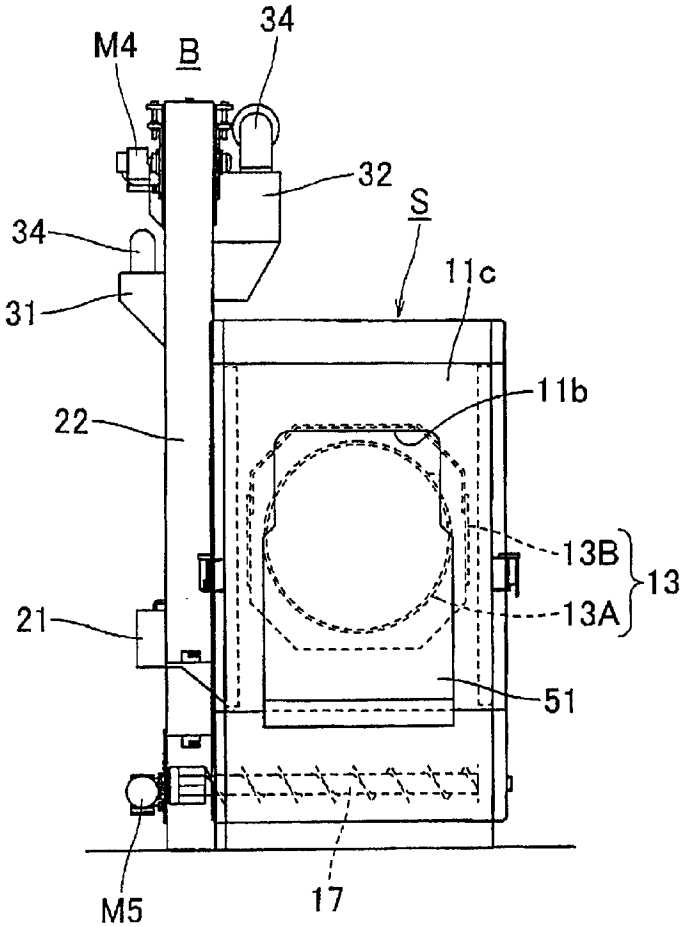
FIG. 3 shows a schematic view (partially omitted) taken along arrows 3-3 in FIG. 2.
Figure 4:
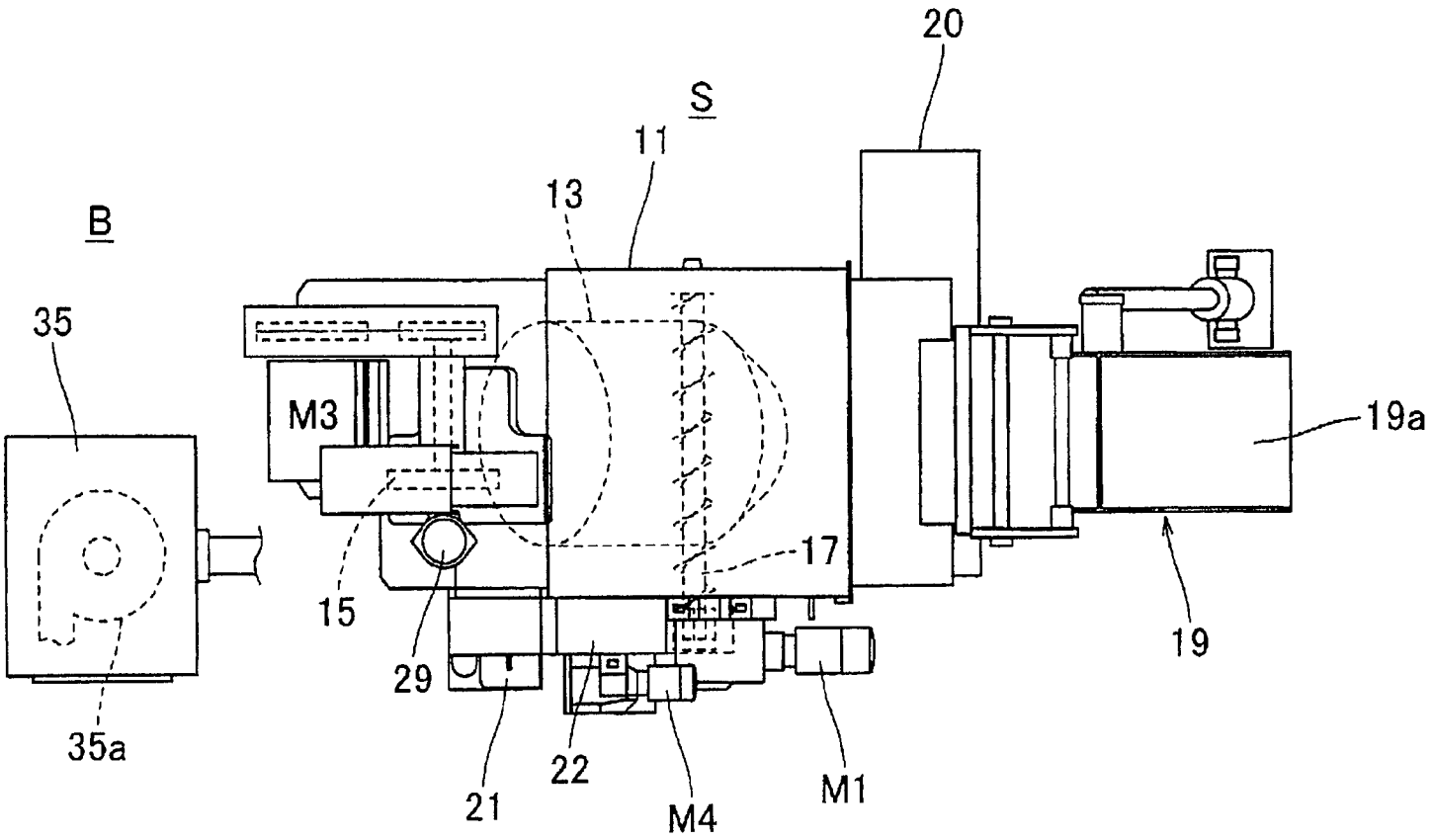
FIG. 4 shows a schematic view (partially omitted) taken along arrows 4-4 in FIG. 2.

The shot-blasting facility that incorporates the shot-blasting machine as an embodiment is now described (see FIGS. 2, 3, and 4). The shot-blasting machine S is used for descaling or deflashing small or thin products.

The shot-blasting machine S comprises a cabinet 11, a rotary drum 13 having holes, and a centrifugal shooting machine 15.

The cabinet 11 has a sealed portion that is hermetically covered by a cover 51, which is discussed below, so that no shots fly outside the cabinet 11 when they are being shot.

The rotary drum 13 is a vessel for uniformly processing the works by holding the works (materials to be processed) within the cabinet 11 and rotating them. The rotary drum 13 is configured to move forward and backward around the horizontal shaft L2 that is perpendicular to the central axis L1 of the rotary drum 13. It moves within the cabinet 11 through the positions for feeding the materials to be processed, for processing them, and for taking them out.

The centrifugal shooting machine 15 is provided on the upper part of the back side of the cabinet 11. It shoots the shots (shot materials) toward the opening of the rotary drum 13 by accelerating them.

The shot-blasting facility is equipped with a device for feeding the works and a device for taking out the works from the front (the right side on FIG. 2) of the shot-blasting machine (the cabinet) S so as to operate the shot-blasting machine S in a batch mode. It is equipped with a device for supplying the shots in both one side (the near side in FIG. 2) of, and the back of, the shot-blasting machine (the cabinet) S. The device for supplying the shots is used when processing the works.

Figure 12:
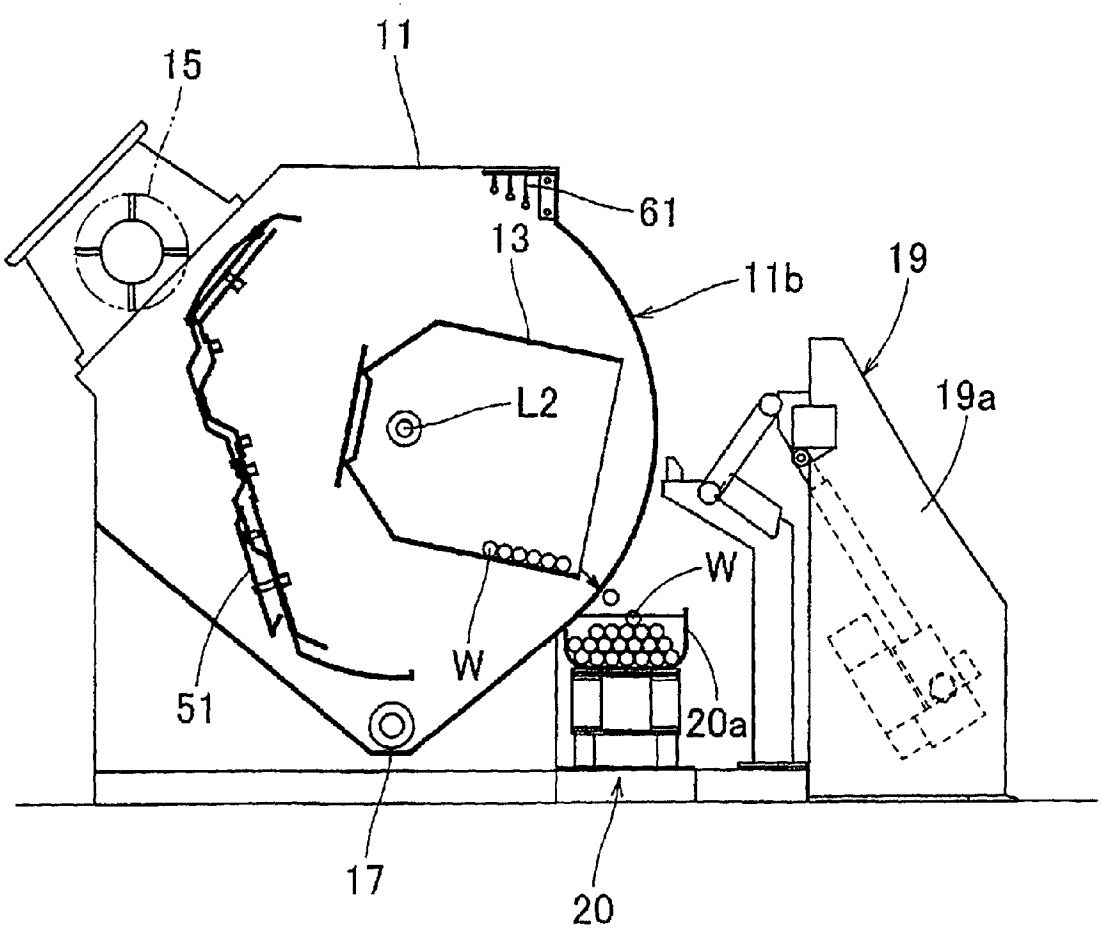
FIG. 12 illustrates a positional relationship similar to that in FIG. 10 when the works are taken out.

The device for feeding the works comprises a bucket loader 19 that has a bucket 19*a* for feeding the works. The bucket 19*a* is a box to hold the works (materials to be processed), and it vertically moves and tilts by moving forward and backward around an axis. It feeds works to the rotary drum 13 that tilts to the position for feeding the works (obliquely and upward in the front side) (see FIG. 10). The device for taking out the works comprises a conveyer 20 that has troughs 20*a* for receiving the works. The troughs 20*a* receive the processed works that are taken out from the rotary drum 13 that tilts to the position for taking out the works (obliquely and downward in the front side) (see FIG. 12).

The device for supplying the shots comprises a bucket-type lift conveyor 22 for lifting the shots that have been supplied from a box 21 for supplying shots to the cabinet 11. It also comprises a separator 23 that is connected to an upper taking-out port of the lift conveyor 22, a hopper 24 that is provided below the separator 23, a pipe 25 for supplying the shots, a pipe 26 for discharging crushed materials, and so on. A screw conveyor 17 for retrieving the shots is provided at the lower portion (bottom) of the cabinet 11. The port for taking out the shots of the conveyor 17 for retrieving the shots is connected to the lift conveyor 22 to retrieve the shots that have been shot together with dust and scales that have been generated during the processing step. Shots that can be reused are separated (classified by using air) from the retrieved materials by the separator 23 so as to return them to the centrifugal shooting machine 15. Thus they are recirculated.

The crushed materials such as shots that have been classified by using air by means of the separator 23 are discharged through the pipe 26 for discharging crushed materials.

The lift conveyor 22 and the separator 23 are connected to the cabinet 11 to form a hermetically sealed space. The space is connected to a dust collector 35 via connectors 31, 32 for connecting the duct and via ducts 34, 35. The dust collector 35 has a suction fan 35*a*.

The connector 31 for connecting the duct to the lift conveyor 22 is mainly used for suctioning and discharging dust that is generated in the cabinet 11.

The connectors 32 for connecting the duct to the separator 23 is used for removing light materials such as dust and scales, and shots, which cannot be reused, before the separator 23 separates usable shots from the retrieved shots so as to again feed them to the centrifugal shooting machine 15.

Shots (that have been worn or crushed) that are heavier than dust but lighter than the usable shots and scales are classified by using air by means of the separator 23. They are discharged outside the shot-blasting machine S through the pipe 26 for discharging crushed materials that is connected to the separator 23.

The usable shots that have been classified by using air by means of the separator 23 are transported to a port 29 for supplying the shots through a pipe 25 that is connected to the hopper 24. Any shots that exceed the capacity of the hopper 24 to hold them are transported to the box 21 for supplying the shots through a pipe 27, to have the shots overflow so that they are recirculated to the centrifugal shooting machine 15 by the lift conveyor 22. The number 28 in FIG. 2 denotes a gate for starting and stopping the supply of the shots to the centrifugal shooting machine 15 and for controlling the flow of them.

The rotary drum 13 of the shot-blasting machine S is configured to move forward and backward around the shaft L2 by means of a driving motor M1 (a revolution) and to rotate by means of a driving motor M2 (see FIG. 5) (a rotation). The rotary drum 13 has many holes of a size to allow the shots to pass through them, but that prevents the works from passing through them.

The centrifugal shooting machine 15 is driven by a driving motor M3 via a power transmission belt.

The lift conveyor 22 and the conveyor 17 for retrieving the shots are driven by driving motors M4 and M5, respectively.

Next, an embodiment that corresponds to the characteristic structures of the present invention is now described.

The cabinet 11 basically comprises a cover 51 for shutting the opening 11*b* for feeding and discharging the materials to be processed. The wall 59 for sealing is formed by a ceiling

Figure 5:
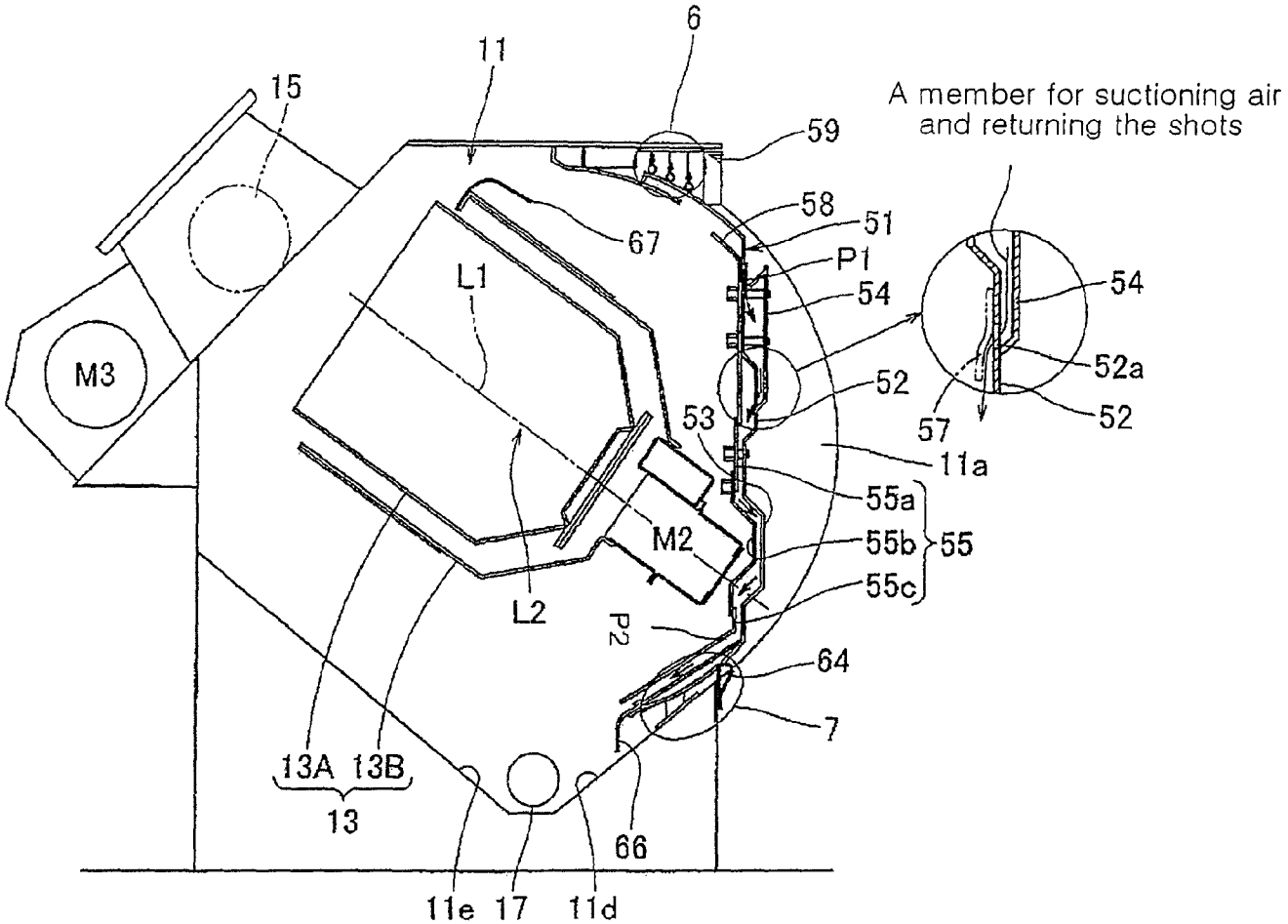
FIG. 5 is a sectional view of an embodiment of the shot-blasting machine of the present invention, with a part omitted.
Figure 8:
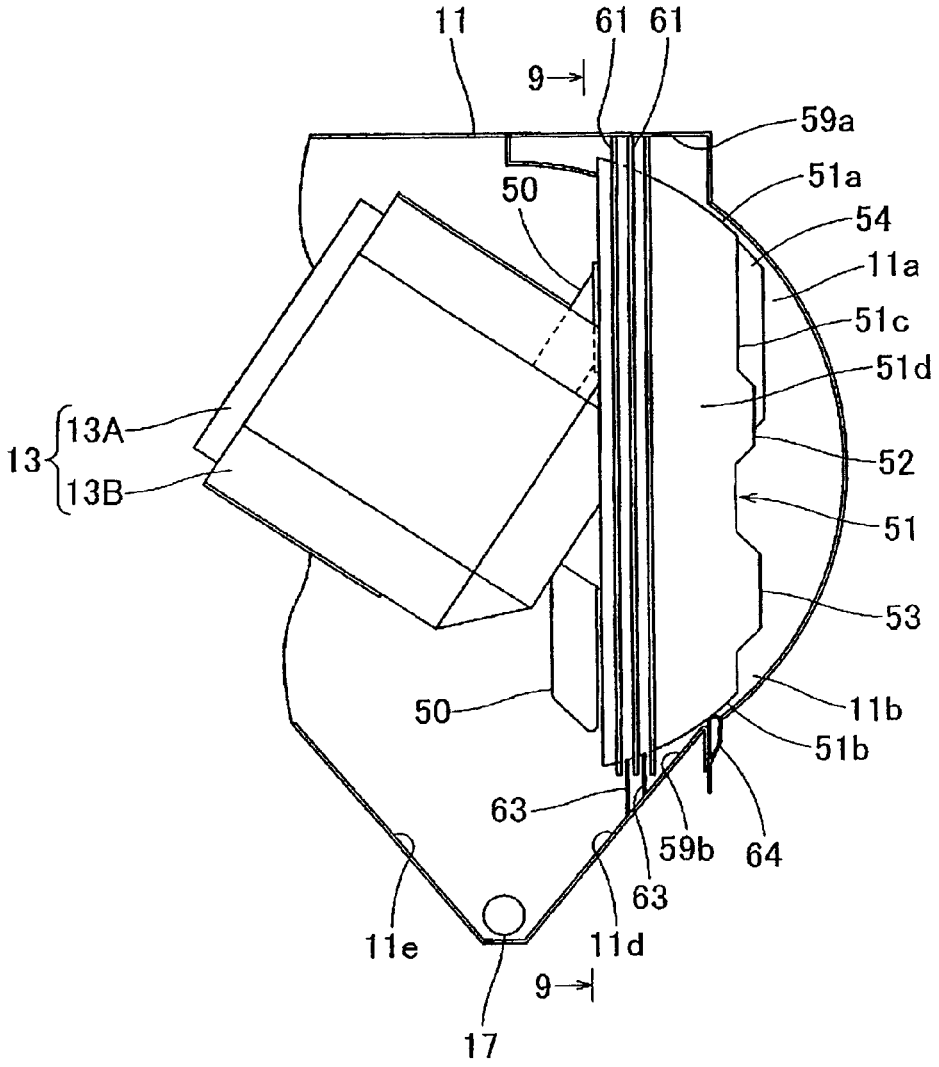
FIG. 8 illustrates the positional relationships between the cabinet, the seals, and the cover when the cover is closed.
Figure 9:
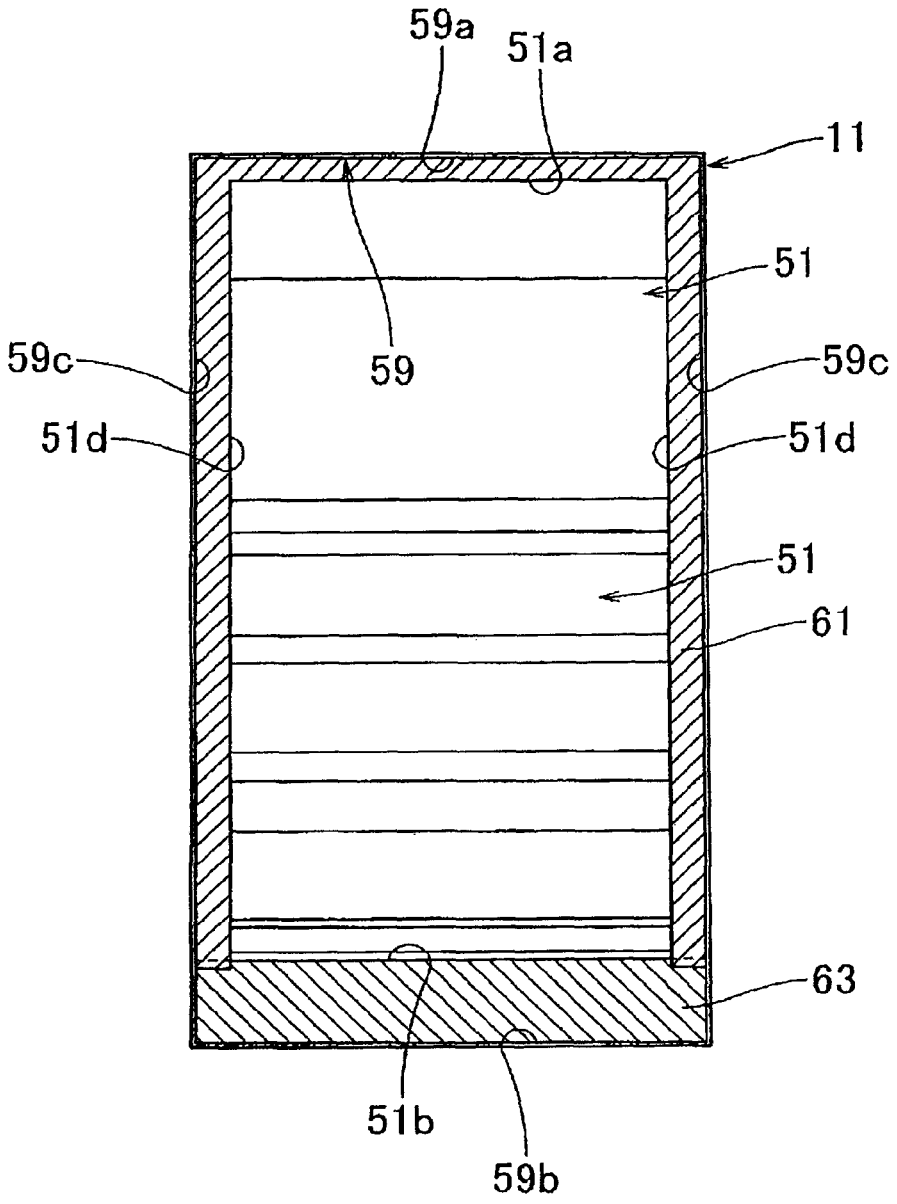
FIG. 9 shows a schematic view taken along arrows 9-9 in FIG. 8.

59*a*, bottom wall 59*b*, and two side walls 59*c*, 59*c* on the side of the opening 11*b* in the cabinet 11 (especially see FIGS. 5, 8, and 9).

Arched-shaped projecting walls 11*a*, 11*a* project from both sides of the wall 59 for sealing in the cabinet 11. They are shaped to have semicircular portions on both the upper and lower parts. The front sides of them have the opening 11*b* that is wider at the bottom side. The conveyor 17 for retrieving the shots is provided on the bottom of the cabinet 11 with its axis in the width direction of the cabinet 11. The cabinet 11 has sloped bottom walls 11*d*, 11*e* so as to bring the shots, after they are shot, to the conveyor 17 for retrieving the shots.

The cover 51 is integrated with the rotary drum 13 via frames 50, 50 (see FIG. 8). It moves forward and backward around an axis together with the rotary drum 13. It comprises upper and lower arc portions 51*a*, 51*b* that fit the wall 59 for sealing. It also comprises a string portion 51*c* that connects the front sides of the arc portions 51*a*, 51*b*. It also comprises two side portions 51*d*, 51*d* that enclose the space between the string portion 51*c* and the upper and lower arc portions 51*a*, 51*b*. Thus it is shaped like a boat.

At least one line of a lip seal is provided at the gaps between the upper and lower arc portions 51*a*, 51*b* and the two side portions 51*d*, 51*d* of the cover 51 and the wall 59 for sealing to seal the gaps.

Figure 7:
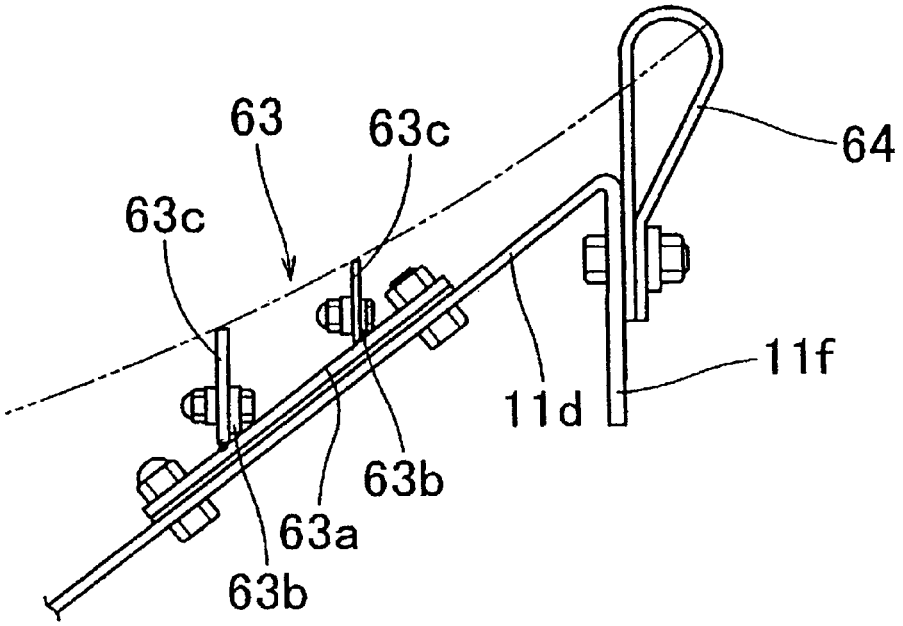
FIG. 7 shows an enlarged sectional view of the portion 7 in FIG. 5.

An example of the seal in the drawings (FIGS. 7 and 8) is provided for better manufacturing and assembling, and shown as follows. Three lines of first seals 61 are provided on the ceiling 59*a* and two side walls 59*c*, 59*c* of the wall 59 for sealing the opening. Two lines of second seals 63 are provided on the bottom wall 59*b*. Further, one line of a third seal 64 is provided along a bent wall 11*f* that is positioned at the bottom end of the opening 11*b* of the cabinet 11. The present invention is not limited to that structure. The second seals 63 or the third seal 64 may be replaced by the first seals 61. A portion of the first seals 61 may be replaced by the third seal 64.

Figure 6:
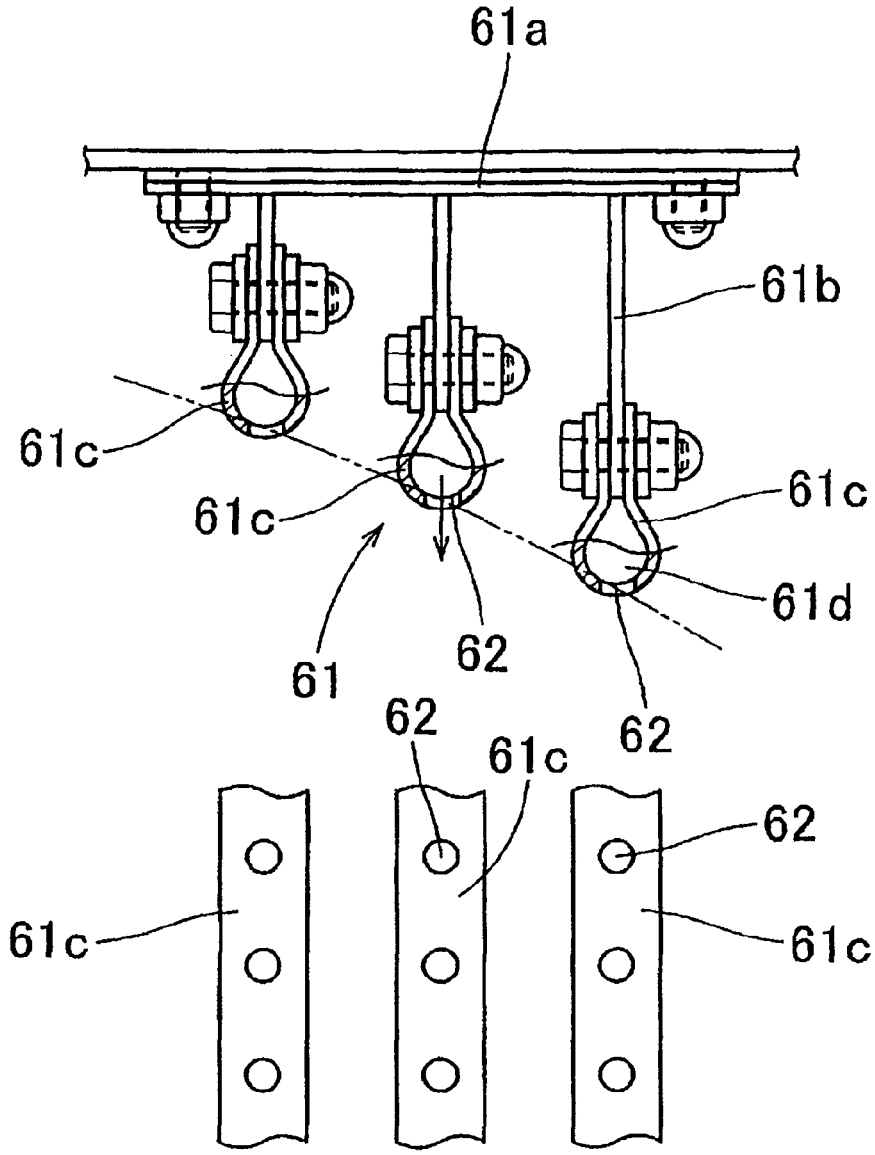
FIG. 6 shows an enlarged sectional view of the portion 6 in FIG. 5 and a view of the bottoms of the seals taken in the direction of the arrow.

The first and second seals 61, 63 are lip seals. That is, desired lines of fins 61*b*, 63*b* project from the bases 61*a*, 63*a* that are screwed to the wall 59 for sealing. Sealing lips 61*c*, 63*c* are respectively screwed to the fins 61*b*, 63*b* (see FIGS. 6 and 7).

The tips of the lip seals 61*c* of the first seals 61 have U-shaped cross-sections. A belt that has at predetermined intervals (20 to 100 mm, for example) holes 62 for releasing the shots is folded to be a ring to form the U-shape. Since the tips are formed to be U-shaped, the sealing properties and properties of the first line for blocking the shots are increased. In the present embodiment, a ceiling 59*a* and side walls 59*c* are not sealed by just one seal (an inverted U-shape in the front view), for better manufacturing and assembling. The first seal 61 is divided into the seal for the ceiling that is held by the ceiling 59*a* and the seals for the sides that are held by the side walls 59*c*. Thus the holes 62 for releasing the shots are formed in the sealing lip 61*c* of the first seal 61. That is, if the shots enter the inside 61*d* of the sealing lip 61*c* by passing through the gap that is formed between the ceiling and the sides of the seal 61, the shots are discharged through the holes 62 from the sealing lip 61*c* when taking out the works (see FIG. 12).

The sealing lips 63*c* of the second seals 63 are made of fins that are portions of the belt, with no modification made to them. The second seals 63 are made of fins, because substantially few shots reach the positions where the second seals 63 are positioned, i.e., the front sloped bottom wall 11*d* of the cabinet 11. Thus there is no need to make those seals like the first seals 61, and any seals that prevent dust that has been generated from leaking can be used.

The third seal 64 is formed by bending a belt. Because it is used as a secondary seal, it also prevents dust from leaking. Thus, only one of the second seals or the third seal, need to be provided.

The first seals 61 or the second seals 63 may be attached to the cover 51.

In the present embodiment a mechanism for returning the shots is provided from the upper part of the front portion to the back of the cover 51, but it is not mandatory. Thus if the shots were to fly out, they would not scatter outside the cabinet 11.

The cover 51 comprises a lane of an upper horizontal and long projection 52 and a lane of a lower horizontal and long projection 53. A plate 54 forms a receiving route P1 on the front of the cover 51. A plate 55 forms a discharging route P2 on the back of the cover 51. The receiving route P1 and the discharging route P2 are connected via a horizontal conducting slit 52*a* that is formed in the upper horizontal and long projection 52 on the cover 51. The plate 55 for forming the discharging route is divided into three plates 55*a*, 55*b*, 55*c* for better manufacturing and assembling. The horizontal conducting slit 52*a* is preferably configured like a non-return valve by closing the backside of it by a non-return flap 57. So even if the pressure in the cabinet 11 becomes higher than the atmospheric pressure, dust would be prevented from leaking outside the cabinet 11 through the horizontal conducting slit 52*a*.

A flap 66 for returning the shots is provided at the bottom of the cover 51 so as to smoothly bring the shots that are discharged from the discharging route P2 to the conveyor 17 for retrieving the shots.

A liner 58 (normally made of a steel plate) may be provided, to prevent wear, on the back of the cover 51 and the portion facing the shooting portion of the centrifugal shooting machine 15 (the upper-right portion in FIG. 5).

In the present embodiment, the rotary drum 13 consists of an inner cylinder 13A having holes and an outer cylinder 13B also having holes. The outer cylinder surrounds the inner cylinder 13A. The works are fed into the inner cylinder 13A. Further, a leading flap 67 for taking out the works is attached to the outer cylinder 13B. The leading flap 67 is attached to a position which comes to the lower side of the rotary drum 13 when the rotary drum 13 is in the position for taking out the works. The leading flap 67 functions to smoothly take out the processed works from the rotary drum 13 to the conveyor 20 for taking out the works.

Next, the process that proceeds at the shot-blasting facility incorporating the shot-blasting machine S is the following (especially see FIGS. 2, 5, 10, 11, and 12).

1. In preparation, the works W are put in a bucket 19*a* of the bucket loader 19 at the position for doing so (the solid line in FIG. 10). Meanwhile, the shots (materials to be blasted) are supplied from the box 21 for supplying shots of the lift conveyor 22 to the cabinet 11.

2. The rotary drum 13 is tilted to the position for feeding the works in FIG. 10. At that position the cover 51 tilts together with the rotary drum 13 to open the opening 11*b* so as to feed the works into the cabinet 11 through the opening 11*b* that is positioned at the front of it.

Figure 10:
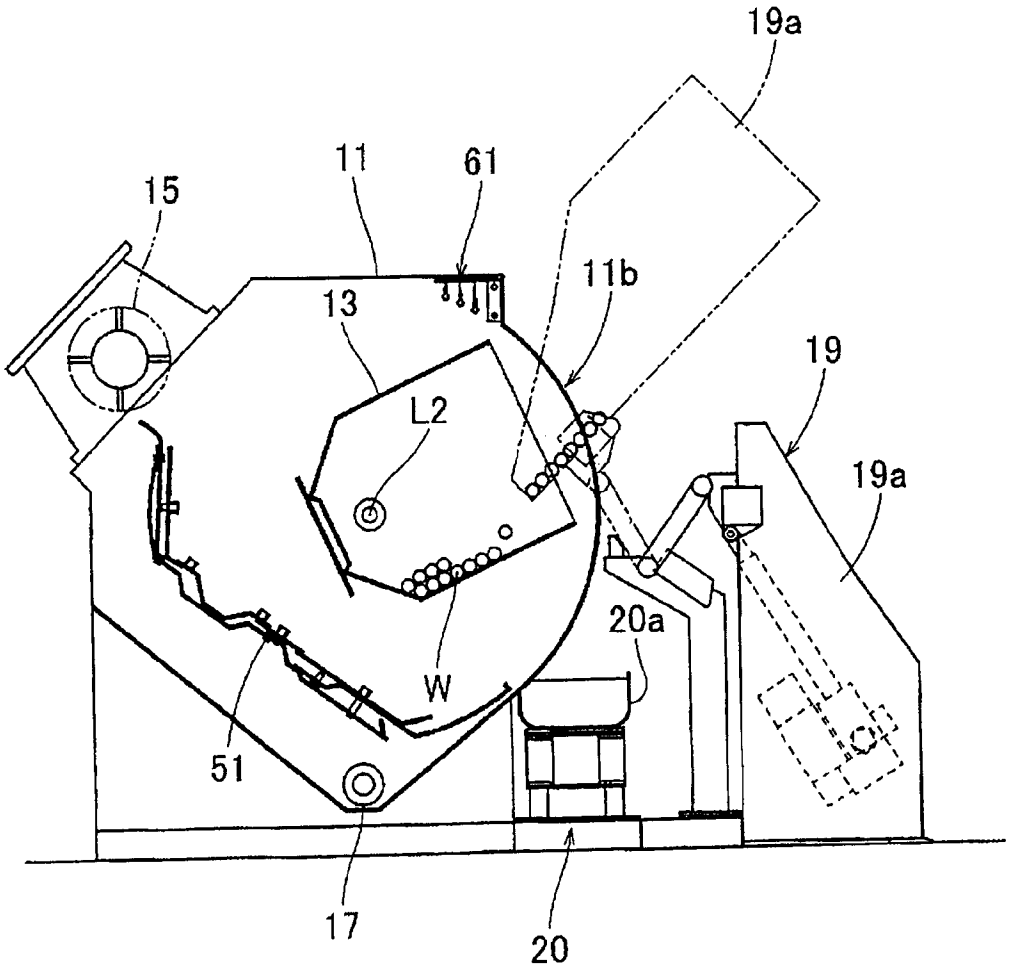
FIG. 10 illustrates the positional relationship between a device for feeding the works and the shot-blasting machine when the works are fed.

Under that condition the bucket 19*a* is moved upward around an axis and tilted to the position for feeding the works (the dotted line in FIG. 10). The works are fed into the rotary drum 13.

Figure 11:
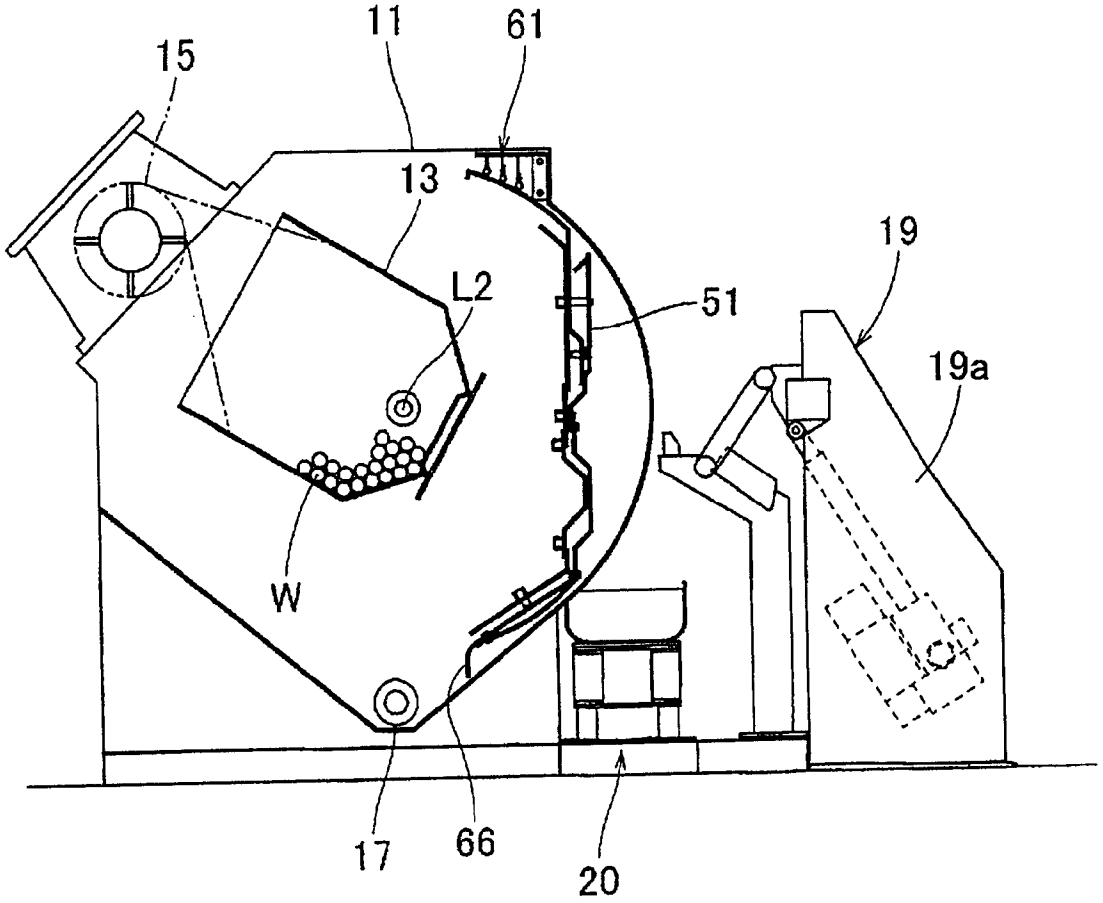
FIG. 11 illustrates a positional relationship similar to that in FIG. 10 when the works are processed.

3. Then, the rotary drum 13 is tilted to the position for processing (FIG. 11). At this position the cover 51 is shut, and the cabinet 11 is hermetically covered. Under this condition the driving motors M2, M3, M4, M5 are activated to rotate the rotary drum 13 and to drive the centrifugal shooting machine 15, the lift conveyor 22, the conveyor 17 for retrieving the works, and the dust collector 35.

By so doing the shots are transported from the lift conveyor 22 to the gate 28 via the separator 23 and the hopper 24. Their flow is adjusted by the gate 28. They are supplied to the centrifugal shooting machine 15 via the pipe 25 for supplying the shots. They are shot by the shot-blasting machine 15 toward the works in the rotary drum 13.

4. While the shots are being shot, that is, during the processing, the pressure within the cabinet 11 is maintained to be slightly lower than the atmospheric pressure. Dust that is generated during the processing is suctioned by the dust collector 35. The ambient air is introduced to the cabinet 11 through the horizontal conducting slit 52*a* of the cover 51.

If the shots were to reach the gap between the cover 51 and the wall 59 for sealing of the cabinet 11, they would not fly outside the cabinet 11, because the gap is sealed by the first and second seals 61, 63.

Further, if the shots were to enter the inside 61*d* of the sealing lip 61*c* after passing through the gap at the connection between the seal for the ceiling and the seals for the sides of the first seals 61, they would fall to the outside of the sealing lip 61*c* through the holes 62 for releasing the shots at the tips of the U-shapes of the seals when the cover is opened (when the works are taken out). Thus they would be returned to the inside of the cabinet 11.

If the shots were to fly outside the cabinet 11 through the first seals 61, they would be returned by the mechanism for returning the shots so as to be returned to the inside of the cabinet 11 through the receiving route P1, the horizontal conducting slit 52*a*, and the discharging route P2 located on the inner face of (on the back of) the cover 51. Then they would slide down the front sloped bottom wall 11*d* to the conveyor 17 for retrieving the shots. Thus they are reused in the same way as the other shots are.

5. After the processing is finished, the driving motor M3 is deactivated to stop the centrifugal shooting machine 15. At this time, since the rotary drum 13 continues to rotate, the shots inside it are taken out through the holes (they slide down in the cabinet 11). The time required to take out all the shots from the rotary drum 13 depends on the amounts and shapes and sizes of the works W and the shots. Thus there may be a case where all the shots are taken out from the rotary drum 13 in a short time. However, dust may fly in the cabinet 11 after blasting the shots. If the cover 51 were opened under that condition, dust would leak outside the cabinet 11. This is undesirable for the working environment. To ventilate the cabinet by the dust collector 35 so that the concentration of dust in it is at the same level as the ambient air, time is required for the dust collector 35 to suction air three times the volume of the cabinet 11. Since the dust collector 35 operates when the shots are taken out, the time for taking out the shots is preferably set to be equal to or more than the time that is required for the dust collector 35 to suction air three times the volume of the cabinet 11, because dust in the cabinet is discharged.

Then, the driving motor M1 is activated to tilt the rotary drum 13 to the position for taking out the works. By doing so the leading flap 67 that is attached to the outer cylinder 13B of the rotary drum 13 is located at the position where the works are taken out from the rotary drum 13, i.e., the lower position of it. Therefore, the works are smoothly taken out to the troughs 20*a* for receiving the works of the conveyor 20 for taking out the works.

Some of the shots may not be taken out from the rotary drum 13 during the step for taking them out (or, the step for discharging the shots). Under this condition, if the shots together with the works W are taken out to the troughs 20*a* for receiving the works, a member (for example, a wire mesh) that has apertures, through which the shots pass but the works cannot, may be provided to the troughs 20*a*. That member may be placed above the bottom of the troughs 20*a*. A path to retrieve the shots that have passed through the member may be formed to separate the works from the shots while the works W are being conveyed by the conveyor 20 for taking out the works.

By repeating the steps as discussed above, the works can be processed as a batch.

Figure 13:
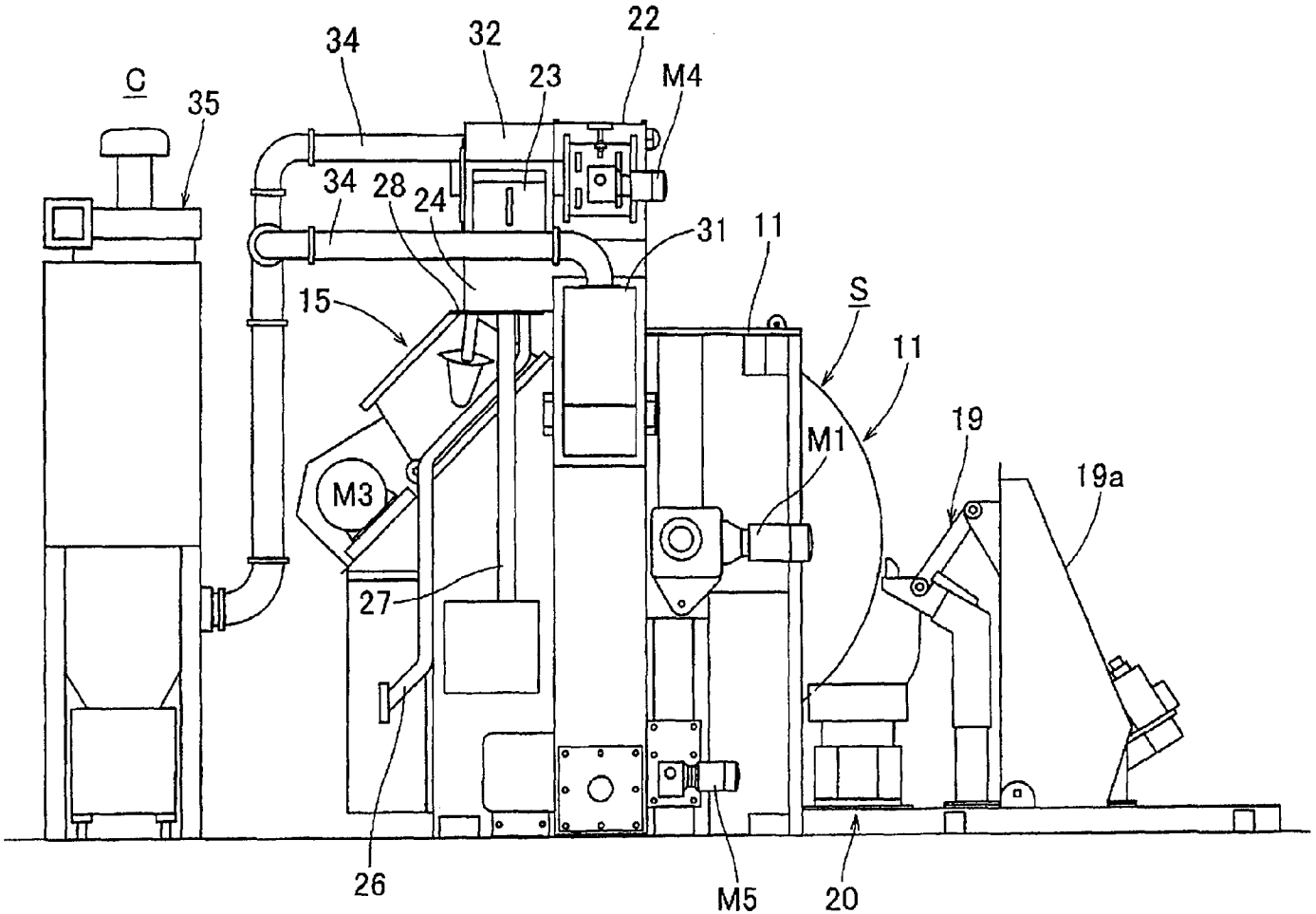
FIG. 13 shows a side view of the shot-blasting facility that incorporates the shot-blasting machine.
Figure 14:
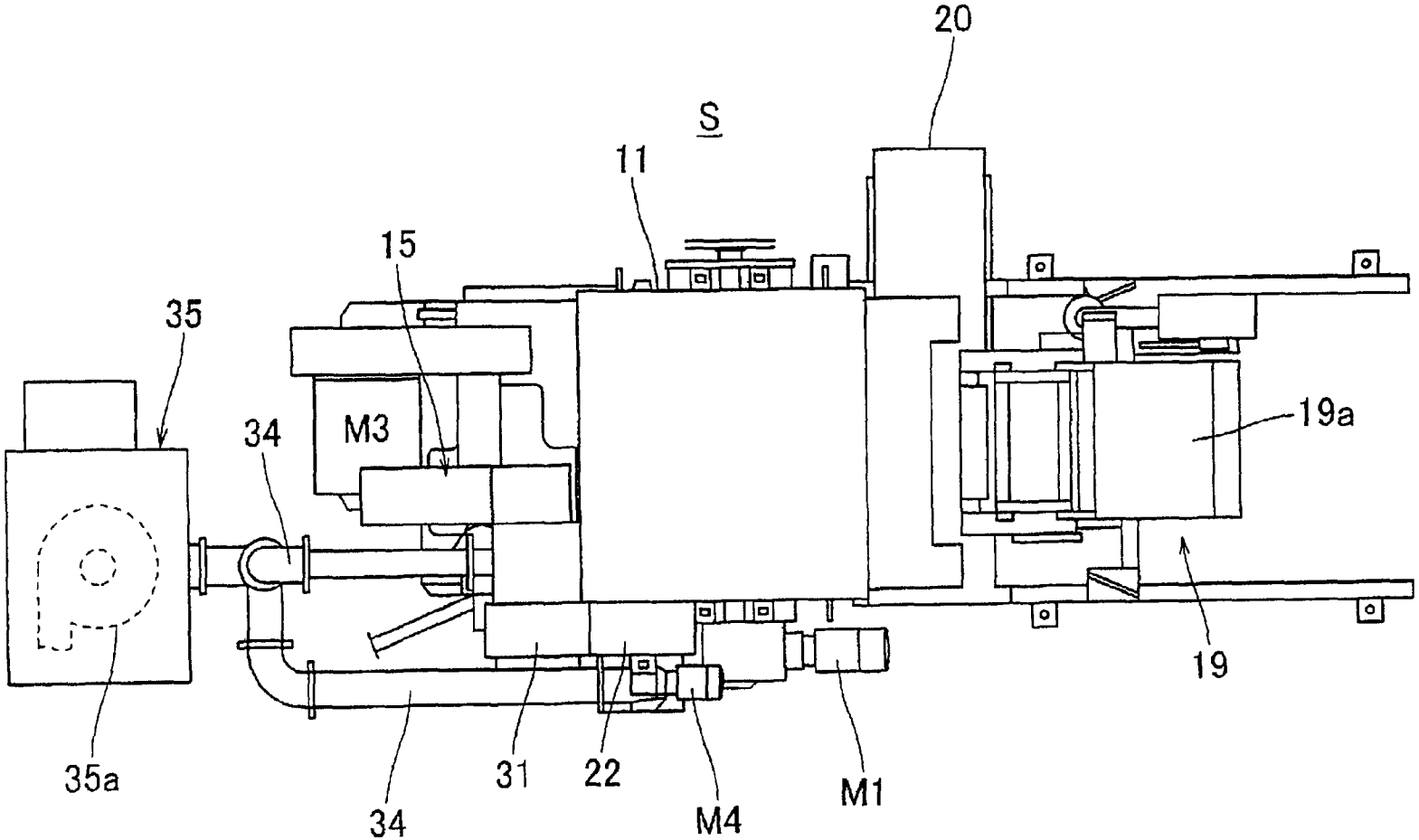
FIG. 14 shows a plan view of the shot-blasting facility in FIG. 13.
Figure 15:
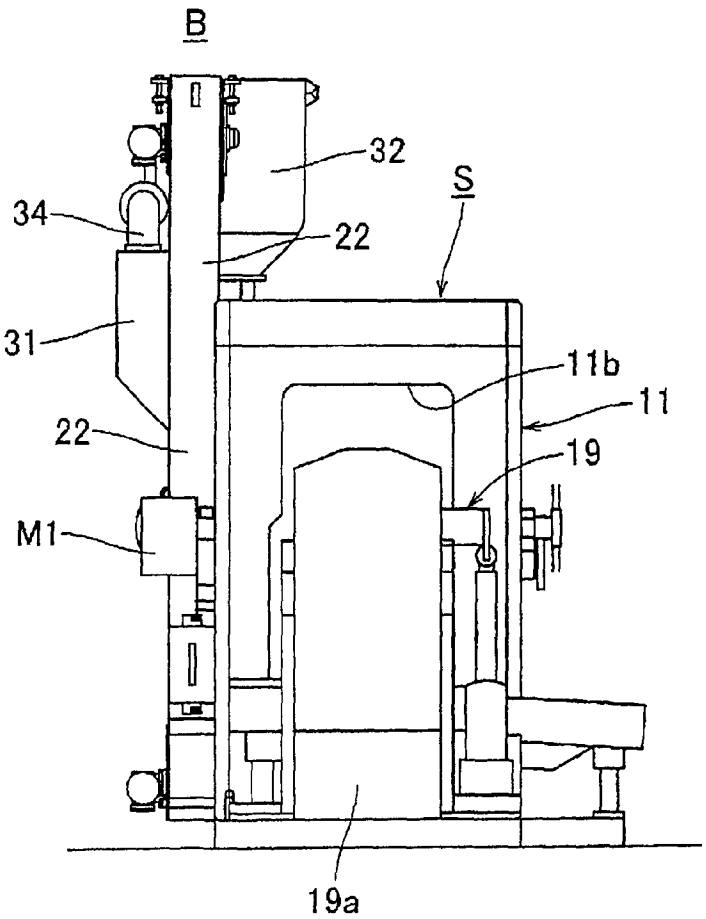
FIG. 15 shows a front view of the shot-blasting facility in FIG. 13.

FIGS. 13, 14, and 15 are respectively side, plan, and front views of the shot-blasting facility that incorporates the shot-blasting machine of the present invention, so as to illustrate the outline of it. Incidentally, some ancillary members may slightly differ from those in FIGS. 2 to 12.

The invention claim is:

1. A shot-blasting machine comprising:

a cabinet, a rotary drum that has holes, and a centrifugal shooting machine, wherein the rotary drum is configured to move, within the cabinet, forward and backward around a horizontal shaft that passes through a central axis of the rotary drum to move through operating positions for feeding materials to be processed, for processing the materials, and for taking out the materials, wherein the cabinet has a cover for shutting an opening for feeding the materials to be processed and taking out the materials, and the cabinet having on a side of the opening a wall for sealing that consists of a ceiling, a base, and two side walls, wherein the cover is integrated with the rotary drum to be movable forward and backward around an axis, the cover comprising upper and lower arc portions that can fit the wall for sealing, a string portion for connecting a front side of the upper arc portion to the front side of the lower arc portion, and two side portions that enclose the space between the string portion and the upper and lower arc portions, wherein a seal is formed by at least a line of a lip seal that is provided at gaps between the upper and lower arc portions and the two side portions of the cover and the wall for sealing, wherein the seal comprises three lip seals and is fixed to the ceiling of the wall for sealing so as to contact the upper arc portion, wherein the cover comprises a conducting slit located at a medium height, the conducting slit extending horizontally, wherein a mechanism for returning the shots is provided, the mechanism returning the shots from an upper and front portion to a back and lower portion of the cover via the conducting slit so that the shots that fly outside the cabinet during a shot-blasting operation are returned to an inside of the cabinet, and wherein a non-return flap for shutting the conducting slit of the mechanism for returning the shots is provided to a back side of the cover.

2. The shot-blasting machine of claim 1, wherein a tip of the seal has a shape that has a U-shaped section on sides of at least the ceiling and two side was of the wall for sealing.

3. The shot-blasting machine of claim 2, wherein a bottom of the U-shaped section of the seal contacts a wall of the cover, and wherein the seal has holes for releasing the shots.

4. The shot-blasting machine of claim 1, wherein the mechanism for returning the shots also functions as a mechanism for introducing ambient air.

5. The shot-blasting machine of claim 1, wherein the rotary drum comprises an inner cylinder for receiving the works and an outer cylinder having holes, the outer cylinder surrounding the inner cylinder, and wherein a leading flap for taking out the works is attached to the outer cylinder having holes.

* * * * *